US010798965B2

(12) United States Patent
Richmond et al.

(10) Patent No.: US 10,798,965 B2
(45) Date of Patent: Oct. 13, 2020

(54) MULTI-STAGE FILTRATION DEVICE

(71) Applicant: Banana Bros, LLC, Culver City, CA (US)

(72) Inventors: David Richmond, Culver City, CA (US); Howard Richmond, Los Angeles, CA (US)

(73) Assignee: Banana Bros, LLC, Culver City, CA (US)

( * ) Notice: Subject to any disclaimer, the term of this patent is extended or adjusted under 35 U.S.C. 154(b) by 0 days.

(21) Appl. No.: 15/839,694

(22) Filed: Dec. 12, 2017

(65) Prior Publication Data

US 2019/0174818 A1 Jun. 13, 2019

(51) Int. Cl.

| | |
|---|---|
| ***A24D 3/04*** | (2006.01) |
| ***A24D 3/16*** | (2006.01) |
| ***A24D 3/10*** | (2006.01) |

(52) U.S. Cl.

CPC ..... *A24D 3/045* (2013.01); *A24D 3/10* (2013.01); *A24D 3/163* (2013.01); *A24D 3/166* (2013.01)

(58) Field of Classification Search

None

See application file for complete search history.

(56) References Cited

U.S. PATENT DOCUMENTS

| | | | | |
|---|---|---|---|---|
| 4,253,508 | A * | 3/1981 | Bodai | A24D 3/045 131/202 |
| 4,660,579 | A * | 4/1987 | Horsewell | A24D 3/04 131/339 |
| 5,019,262 | A * | 5/1991 | Wang | A24D 3/08 131/332 |
| 2003/0140933 | A1 | 7/2003 | Eichel | |
| 2007/0056600 | A1 * | 3/2007 | Coleman, III | A24D 3/14 131/332 |
| 2016/0302477 | A1 * | 10/2016 | Besso | A24D 3/04 |

FOREIGN PATENT DOCUMENTS

| | | |
|---|---|---|
| RU | 2140758 | 11/1999 |
| RU | 57560 | 10/2006 |
| RU | 88516 | 11/2009 |
| RU | 2468851 | 12/2012 |
| WO | WO1997042467 | 11/1997 |

* cited by examiner

*Primary Examiner* — Eric Yaary

(74) *Attorney, Agent, or Firm* — Smyrski Law Group, A P.C.

(57) ABSTRACT

A filter device including a Bernoulli element is provided. The filter device includes a housing, a plurality of permeable membranes positioned in association with the housing to create a plurality of chambers in the housing, and a Bernoulli element positioned within one chamber, wherein the Bernoulli element causes airflow and pressure to vary within the one chamber when fluid comprising smoke is drawn into the filter device.

20 Claims, 7 Drawing Sheets

MULTI-STAGE FILTRATION DEVICE

BACKGROUND

I. Field

The present invention relates generally to filters used with smoking products, and more specifically multi-stage filters designed to minimize particulates passing to the user when smoking.

II. Background

A great number of filters have been employed for use with tobacco products, and most tobacco cigarettes sold commercially include some form of filter designed to filter impurities from the tobacco smoke prior to being inhaled by the smoker. Notwithstanding the intended purpose of the heretofore known filters, such filters have not been highly successful in removing harmful ingredients from the tobacco smoke prior to being inhaled. Numerous proposals have been suggested for altering the commercial variations of the present-day filters for removing the harmful ingredients from the smoke, and these have included the concept of using fibrous filters, adsorbent materials, and introducing water or other liquids into a tobacco smoke filter.

Tobacco smoke is a complex mixture of gaseous compounds and particulate matter. Currently available tobacco fibrous filters such as natural cotton and synthetic cellulose esters offer limited benefits to the smoker, such as an ability of the tobacco filter to dilute particulate matter from the pyrolytic by-products which pose health hazards, tissue irritation, and risks associated with the development of tumors in lung and bronchial tissues of the end user of the tobacco product.

Studies have found tobacco filters only dilute the particulate matter. Such particulate matter passes through tobacco filters at a relatively constant rate across filter types. For example, one study found that the particle size across six different filter types remained consistent at an average of approximately 0.27 micron. Another study found that tobacco smoke produced a median range of particle sizes from 0.3 micron to 0.5 micron; however, particles were found as small as 0.1 micron. While the filters present on most available cigarettes are effective in reducing levels of certain undesirable particulate matter in tobacco smoke, filters still allow a significant amount of undesirable particulate matter to pass into the mouth and lungs.

Certain designs have sought to address this need, including but not limited to use of absorbent materials such as the use of activated carbon, activated charcoal and silica gel. Activated carbon or charcoal, also known as carbon loaded tobacco filters, have porous surfaces resulting in high surficial areas capable of trapping large volumes of particulate matter and organic chemical compounds. Silica gel is highly hydrophilic and thus absorbs water based particulate matter from the smoke. Additionally, hydrophobic materials have also been used in filters, with highly surfaced polymeric materials belonging to the class of linear or reticulated polyurethanes being one example. Each of these solutions has its own issues. All compounds which work by way of absorption will inevitably reach a point at which the material can no longer absorb particulate matter and will become fully saturated.

The point at which saturation occurs results in the failure to block or absorb additional particulate matter, and such particulate matter will typically be directly deposited to the mouth, lung, and bronchial tissues of the user of the tobacco product causing harm and irritation to the smoker. Furthermore, adsorbent materials in tobacco filters do not truly address the issue of saturation, and seek more to reduce particulate material by any extent rather than to an extent which is functional to the full use of one tobacco cigarette. Adsorbent materials will cause a reduction of the largest particulate material first, and thus will be saturated and less functional as smoking continues and particle size decreases.

Furthermore, most of these heretofore known filters which have suggested the use of a liquid or gel for trapping the harmful ingredients of tobacco smoke have included some form of a fibrous filter body and an enclosed hydrophilic or hydrophobic chamber of frangible construction that was penetrated by manually breaking the chamber or by the use of a rip cord or the like so as to free the liquid for saturation of the fibrous body. Such filter constructions have not been employed widely in industry because of problems with properly saturating the filter body upon release of the liquid from the liquid chamber, and the relative complication related to the construction and use of the liquid chamber. These constructions further greatly materially increased the overall cost of the tobacco article making them highly undesirable to the manufacturer.

While the foregoing discussion has focused on tobacco products, it is to be understood that similar issues exist with respect to other types of products smoked by humans, including but not limited to *cannabis* products. Issues such as those described arise in many smoking situations to varying degrees, and the ability to filter out unwanted impurities is beneficial in any smoking environment.

Therefore, there is a need for a filtering device that more efficiently removes a higher level of particulate matter and a larger range of particulate sizes as compared with previous tobacco filter designs. Benefits may be realized for a filter that is cost effective when employed by smokers of various types of products, including but not limited to *cannabis* and tobacco.

SUMMARY

The following presents a simplified summary in order to provide a basic understanding of some aspects of the claimed subject matter. This summary is not an extensive overview, and is not intended to identify key/critical elements or to delineate the scope of the claimed subject matter. Its sole purpose is to present some concepts in a simplified form as a prelude to the more detailed description that is presented later.

Thus according to one aspect of the present design, there is provided a filter device including a Bernoulli element. The filter device includes a housing, a plurality of permeable membranes positioned in association with the housing to create a plurality of chambers in the housing, and a Bernoulli element positioned within one chamber, wherein the Bernoulli element causes airflow and pressure to vary within the one chamber when fluid comprising smoke is drawn into the filter device.

According to a second aspect of the present design, there is provided a filter device usable to filter a fluid comprising smoke drawn toward a user, comprising a forward chamber formed within a housing and positioned away from the user and formed by a first plurality of permeable membranes, the forward chamber comprising a Bernoulli element and a rearward chamber formed within the housing and positioned toward the user and formed by at least one further permeable membrane. The Bernoulli element causes airflow and pressure to vary within the forward chamber when the fluid comprising smoke is drawn into the filter device.

According to a further aspect of the present design, there is provided a method for filtering impurities from a fluid comprising smoke, comprising initially drawing fluid comprising smoke into a forward end of a multichamber housing, the multichamber housing comprising a forward chamber and a rearward chamber separated by a permeable membrane, the forward chamber comprising a Bernoulli element, and subsequently drawing the fluid comprising smoke over the Bernoulli element in the forward chamber such that fluid flow and pressure vary in the forward chamber, thereby filtering out particles from the fluid comprising smoke.

To the accomplishment of the foregoing and related ends, certain illustrative aspects are described herein in connection with the following description and the annexed drawings. These aspects are indicative, however, of but a few of the various ways in which the principles of the claimed subject matter may be employed and the claimed subject matter is intended to include all such aspects and their equivalents. Other advantages and novel features may become apparent from the following detailed description when considered in conjunction with the drawings.

DETAILED DESCRIPTION

Figure 1:
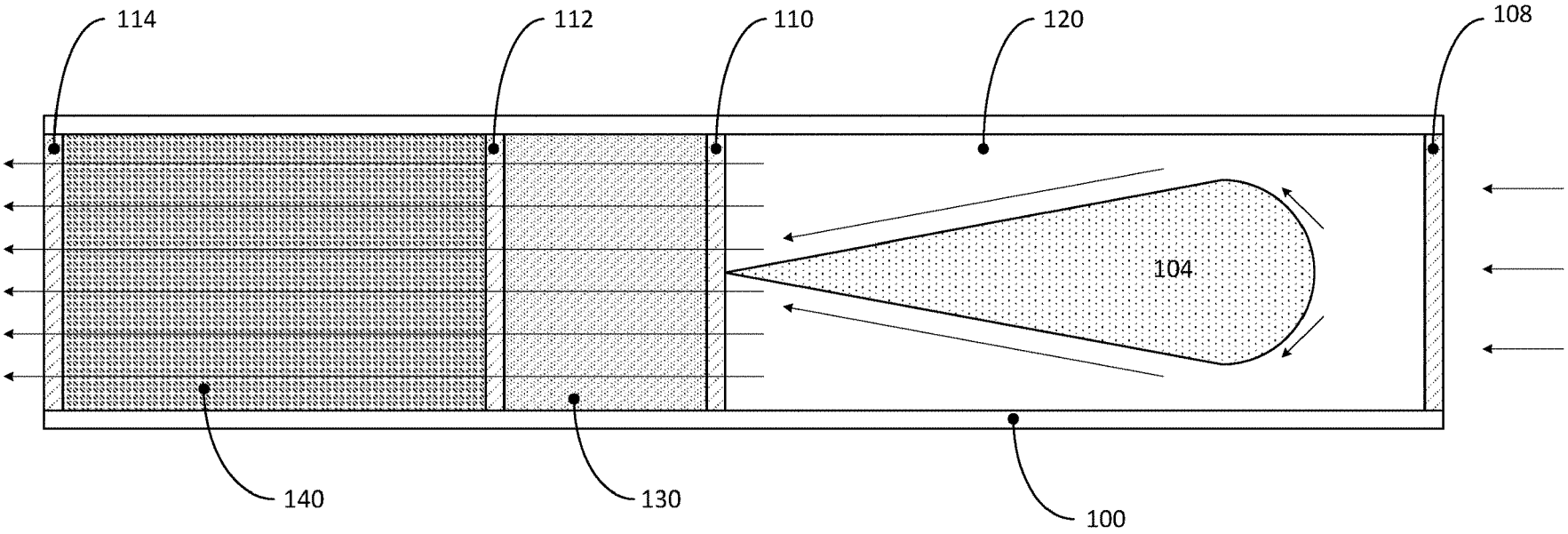
FIG. 1 is a general depiction of a side view of a first embodiment of the present design.

In this document, the words "embodiment," "variant," and similar expressions are used to refer to particular apparatus, process, or article of manufacture, and not necessarily to the same apparatus, process, or article of manufacture. Thus, "one embodiment" (or a similar expression) used in one place or context can refer to a particular apparatus, process, or article of manufacture; the same or a similar expression in a different place can refer to a different apparatus, process, or article of manufacture. The expression "alternative embodiment" and similar phrases are used to indicate one of a number of different possible embodiments. The number of possible embodiments is not necessarily limited to two or any other quantity.

The word "exemplary" is used herein to mean "serving as an example, instance, or illustration." Any embodiment or variant described herein as "exemplary" is not necessarily to be construed as preferred or advantageous over other embodiments or variants. All of the embodiments and variants described in this description are exemplary embodiments and variants provided to enable persons skilled in the art to make or use the invention, and not to limit the scope of legal protection afforded the invention, which is defined by the claims and their equivalents.

In designing a filter usable to help a user inhale reduced flue particulates from smoke while still enjoying the sensation of smoking, the inventors have found that utilizing the principles behind the Bernoulli effect in combination with a three-stage filtration process is of great importance, and a device that provides for largest particulate matter removal at the first of three stages is particularly beneficial. Size of the foil, including relative dimensions and proportions, including proportional considerations relative to the front end and back end of the foil, and total number of filtration stages are of particular interest. Such a device can provide reduced concentration of larger mass particulate matter from smoke flue volume, as well as increased efficacy of tertiary adsorptive material to further reduce smaller particulate matter concentrations, not shown by previous devices, while also maintaining low production costs.

While described herein primarily with respect to tobacco products, it is to be understood that any type of product may be employed, and the description provided herein and specifically the filter discussed may be employed with a cigarette or other smokable product including tobacco, *cannabis*, cloves, or other appropriate material.

The present design includes a Bernoulli foil device, or Bernoulli element, within a filter device having in one embodiment a primary filtration chamber, a secondary filtration chamber behind and attached to the first filtration chamber, a tertiary filtration chamber positioned behind and attached to the secondary filtration chamber, a housing positioned around and encapsulating the primary, secondary, and tertiary filtration chambers. In one aspect, a housing attachment location is provided for attachment to a smoking product sample and an attachment location for attachment of the Bernoulli foil to the housing. Fluid, such as air comprising smoke, flows about the Bernoulli element, changing rate of fluid flow and pressure, and thus enhancing filtration of unwanted particulate matter. As used herein, the term Bernoulli element is general and represents an element that facilitates the Bernoulli effect, while Bernoulli foil is intended to somewhat more specifically refer to a foil type design with in some instances an irregular shape, such as a forward brad section eventually tapering to a pointed or less thick end toward the user, having in some instances similarities to an airplane wing. Neither term is intended to be limiting, and a Bernoulli foil as used herein may broadly encompass other or different element profiles.

The primary filtration chamber containing the Bernoulli device or Bernoulli foil accelerates the particulate matter by increasing gaseous flow speed and stretching the gaseous flue around the foil. Thusly, the larger particulate matter becomes separated from the general gaseous flow due to the mass differences between the larger and smaller particulate matter. The secondary filtration chamber contains standard industry utilized fibrous material such as natural cotton or cellulose esters for capturing the larger particulate materials produced by the foil in the primary filtration chamber. The tertiary filtration chamber contains an adsorptive material, an example of but not limited to, activated carbon or silica gel. The tertiary chamber is thusly left with a greater efficacy to filter a larger quantity of remaining particulate matter with the Bernoulli foil from the primary chamber causes a reduction in premature adsorptive material saturation.

FIG. 1 illustrates one embodiment of the present design. In FIG. 1, housing 100 includes Bernoulli foil 104, providing a general gaseous flow foiling surface positioned behind upstream permeable membrane 108. Primary chamber 120, also known as the forward chamber, is the first chamber that the gaseous flue passes through as smoke travels from the product, such as tobacco, to the end user. Primary chamber 120 contains the Bernoulli foil element 104. Primary chamber 120 has permeable membrane 108 upstream of the gaseous tobacco flue flow and intermediate permeable membrane 110 downstream of the flue flow. The upstream portion is defined as beginning at the product, such as at a tobacco sample, whereupon smoke is drawn from, or air flows from, forward permeable membrane 108 to a downstream portion, where the source of low pressure is created. Thus smoke and airflow travels from forward permeable membrane 108 to downstream permeable membrane 114.

FIG. 1 shows primary chamber 120 containing Bernoulli foil 104. This embodiment of Bernoulli foil 104 has a sloped angle of 28.57 degrees (28.57°) mirrored along the longitudinal axis with a half sphere meeting both slopes on the upstream portion of the foil. The sloped angles of the Bernoulli foil 104 in this embodiment generally fall at angles between the ranges of 27 and 29 degrees (27°-29°), but other dimensions are possible.

FIG. 1 is a cross sectional view looking along the attachment points from the prolateral attachment point of the housing to the contralateral attachment point of the housing. Bernoulli foil 104 is thus attached laterally to housing 100 along the slope of Bernoulli foil 104 at two points so as to not restrict air flow 106 around the curve and slope of the Bernoulli foil 104. The attachment between housing 100 and Bernoulli foil 104 can be made of a single body, such as but not limited to single body injection plastic molding, or by use of known in the art adhesives to adhere Bernoulli foil 104 to housing 100. A deformable material may alternately be employed as Bernoulli foil 104.

Bernoulli foil 104 is so termed because it represents, in this embodiment, a Bernoulli element that acts as a foil, similar to an airfoil or airplane wing. The Bernoulli effect occurs when air flows through a region of lower pressure. In response, when the airflow is constant, the airflow speeds up. The Bernoulli effect causes an airplane wing to cause lift. This shows that in a constant airflow situation, pressure is inversely proportional to velocity of the air. In this filter situation, using Bernoulli foil 104, the beneficial effects of the relationship between pressure and velocity can increase the amount of unwanted particulate matter filtered by the two stage filter.

The construction of Bernoulli foil 104 may be a plastic or other similarly cost-efficient material. Such a plastic can be any type approved for application in and around high temperature applications such as, but not limited to, various polyimides, high density poly ethylene (HDPE), polyethylene sulfides, and polyvinylidene fluorides. Further, any natural materials known in the art to withstand high temperatures such as hard or soft wood or metal alloys may be of suitable durability for consideration in construction of Bernoulli foil 104. Housing 100 may be constructed out of any material suitable for that of constructing the Bernoulli foil 104, and may include materials commonly employed in smoking filters, as well as plastics, natural materials, or even wood or other products able to be smoked by a user and perform the filtering called for herein.

FIG. 1 shows air flow direction 106, indicating the direction of gaseous smoke from the sample located forward of forward permeable membrane 108 as it is being pulled through forward permeable membrane 108. As this gaseous smoke passes across Bernoulli foil 104, the foil causes this smoke to stretch the gaseous flow between forward permeable membrane 108 and intermediate permeable membrane 110. Air flow 106 is thus accelerated around the Bernoulli foil 104 such that heaver larger particulate matter from the tobacco smoke is pulled from and out of the complex gaseous flue mixture. By creating areas of higher pressure and lower pressure around the Bernoulli foil 104, the gaseous smoke mixture can be more thoroughly processed to remove the largest particulate matter at the first stage, in the primary chamber, of the three-stage filtration process.

FIG. 1 shows intermediate permeable membranes provided between each chamber of the filter and permeable membranes are provided on both the upstream and downstream ends of the filter. Forward permeable membrane 108, forward intermediate permeable membrane 110, rear intermediate permeable membrane 112, and downstream permeable membrane 114 may be any type of commonly used permeable membrane known in the art, such as any natural paper like membrane or synthetically derived membrane which is permeable to gaseous flow. Forward permeable membrane 108 may be attached to the sample being smoked by the user and constitutes the furthest point upstream of the present design. Air flow tends to remain generally constant for the filter, with generally uniform laminar flow from forward permeable membrane 108 to downstream permeable membrane 114 when being smoked by a user. Downstream permeable membrane 114 constitutes the furthest downstream point of the design and when being smoked is provided closest to the user's mouth or the part of the design positioned furthest within the user's mouth.

Forward permeable membrane 108 is defined as the most upstream part of the present design and the border between primary chamber 120 and the sample, such as *cannabis* or tobacco. Forward intermediate permeable membrane 110 is between the primary chamber 120 and secondary chamber 130. Rear intermediate permeable membrane 112 is positioned between secondary chamber 130 and tertiary chamber 140. Downstream permeable membrane 114 is most rearward in the design and is positioned between tertiary chamber 140 and the user or open to the environment.

Secondary chamber 130 is composed of fibrous filter articles commonly known to the art such as, but not limited to, natural cotton filters or synthetic cellulose ester filters. Smoke drawn from primary chamber 120 will have been accelerated around the Bernoulli foil 104 as it passes through forward intermediate permeable membrane 110 and will be slowed upon reaching secondary chamber 130. The cumulative effect on air flow 104 reaching secondary chamber 130 from the Bernoulli foil 104 in the primary chamber 120 is that of an accelerated air stream being slowed in secondary chamber 130. Operation of Bernoulli foil 104 in this manner may result in removal of most of the large particulate matter from the smoke flue gaseous complex. Secondary chamber 130, composed from fibrous filters such as, but not limited to, natural cotton or synthetic cellulose ester, functions to filter impurities and further inhibit harmful elements from reaching the user. The accelerated gaseous smoke stream from Bernoulli foil 104 tends to increase the efficacy of the fibrous filter within secondary chamber 130 and removes or tends to remove larger sized particulate matter from the gaseous smoke stream.

FIG. 1 shows tertiary chamber 140 downstream from rear permeable membrane 112 and downstream permeable membrane 114. Tertiary chamber 140 is composed of absorptive materials such as, but not limited to, activated carbon, activated charcoal, or silica gel. One benefit of the absorptive material is filtering out smaller particulate sized particulate matter and harmful toxic by-products of, for example, tobacco pyrolysis such as arsenic, heavy metals, cyanide, and formaldehyde. Further, the absorptive material contained within tertiary chamber 140 can filter out these harmful materials with greater efficacy due to the acceleration provided by Bernoulli foil 104 in primary chamber 120 on the air flow 106, removing a greater degree of large particulate matter from the gaseous smoke complex. Because Bernoulli foil 104 is able to achieve such a high degree of pre-processing and removal of particulate matter from the gaseous smoke, the tertiary chamber 140 is able to absorb a greater degree of harmful by-products than without the assistance of the Bernoulli foil 104 and multi-stage smoke processing in general.

Figure 2:
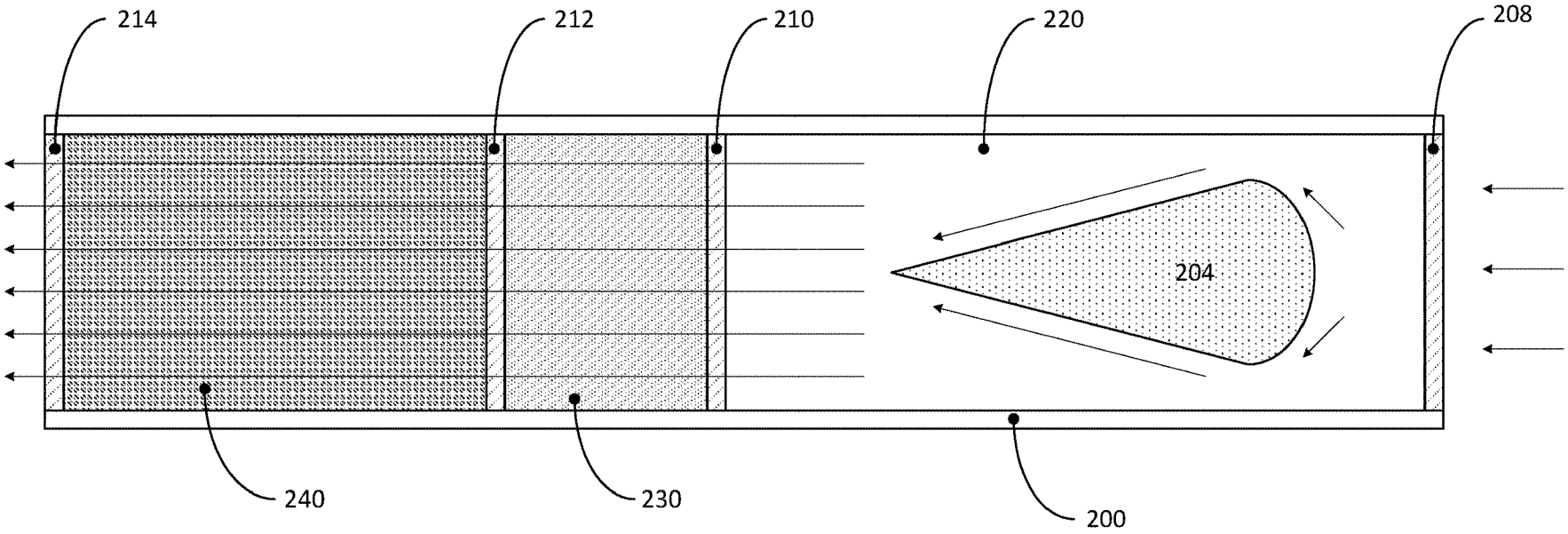
FIG. 2 is a side view of a further embodiment of the present design including a foil type Bernoulli element.

FIG. 2 illustrates an alternate embodiment of the present design. Primary chamber 220 encloses Bernoulli foil 204 within. This embodiment of Bernoulli foil 204 has a sloped angle of 40 degrees (40°) mirrored along the longitudinal axis with a half sphere meeting both slopes on the upstream portion of the foil. The sloped angles of the Bernoulli foil 204 in this embodiment generally fall between the ranges of 39 and 41 degrees (39°-41°). Also shown in this embodiment are housing 200, forward permeable membrane 208, forward intermediate permeable membrane 210, rear intermediate permeable membrane 212, and downstream permeable membrane 214, as well as secondary chamber 230 and tertiary chamber 240. In all embodiments disclosed herein, contents of the secondary and tertiary chambers are similar or identical to the descriptions of those elements provided above with respect to FIG. 1.

Figure 3:
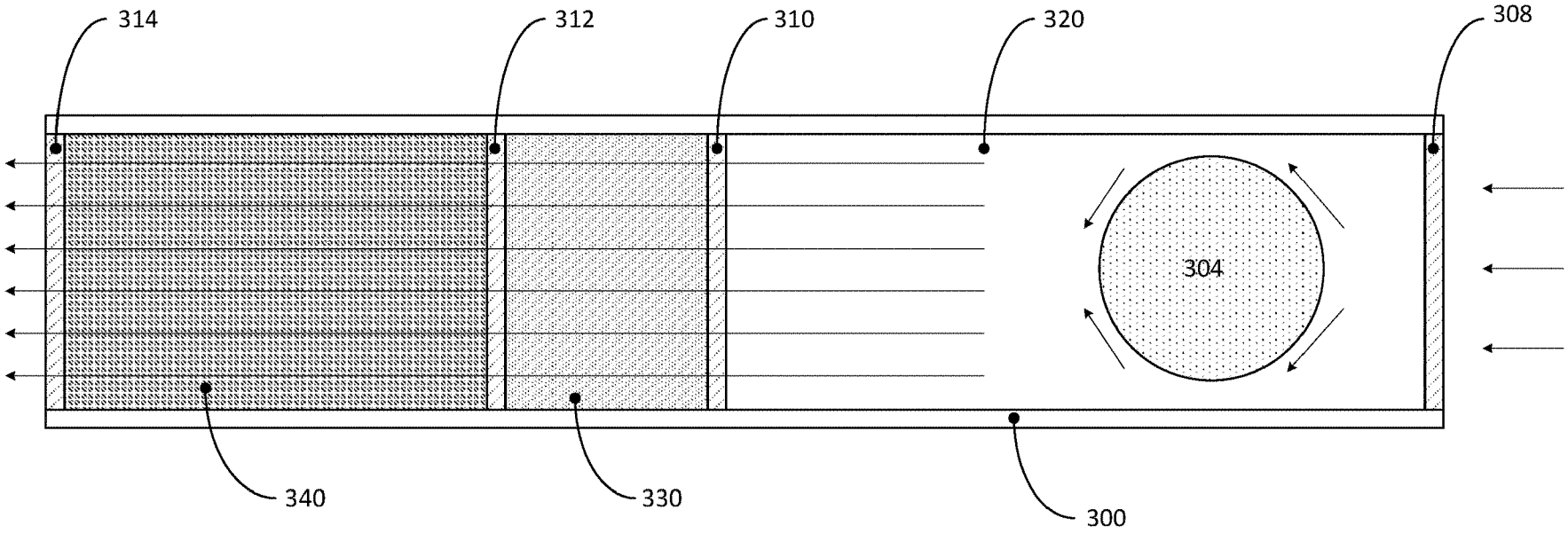
FIG. 3 is a side view of a third embodiment of the present design including an alternate foil type Bernoulli element.

FIG. 3 illustrates a further embodiment of the present design. Primary chamber 320 in this encloses Bernoulli foil 304 within. This embodiment of Bernoulli foil 304 has a circumferential angle of 360 degrees (360°) around the entire annulus and mirrored along both the longitudinal axis and latitudinal axis. The effect of this arrangement is to create a continuous foil in an annular shape. The sloped angles of the Bernoulli foil 304 in this embodiment may be maintained very close to 360 degrees (360°). Also shown in this embodiment are housing 300, forward permeable membrane 308, forward intermediate permeable membrane 310, rear intermediate permeable membrane 312, and downstream permeable membrane 314, as well as secondary chamber 330 and tertiary chamber 340.

Figure 4:
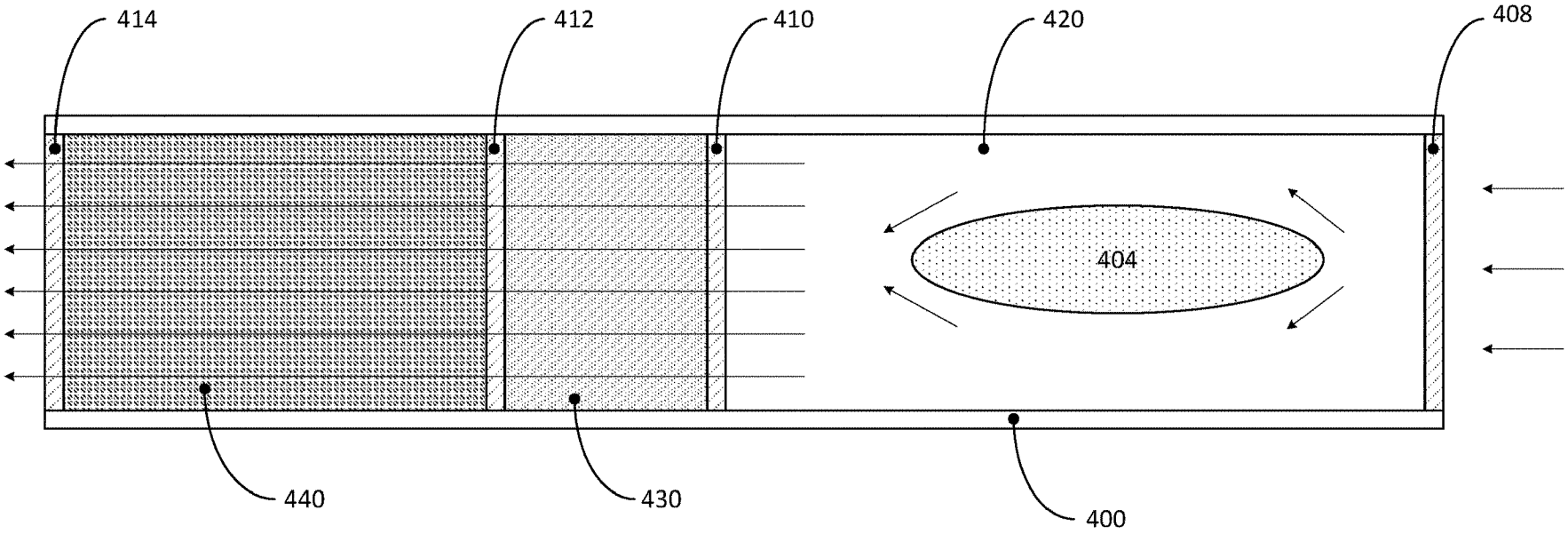
FIG. 4 is a side view of a fourth embodiment of the present design including a circular cross section Bernoulli element.

FIG. 4 illustrates an alternate embodiment of the present design. primary chamber 120 encloses Bernoulli foil 404 within. This embodiment of Bernoulli foil 404 has a sloped angle of approximately 33.33 degrees (33.33°) mirrored along both the longitudinal axis and the latitudinal axis. The effect of this mirroring is to create an ellipse with an equal foiling effect along each quadrant of the Bernoulli foil 404. The sloped angles of the Bernoulli foil 404 in this embodiment should fall between the ranges of 33 and 34 degrees (33°-34°) of each quadrant of Bernoulli foil 404. Also shown in this embodiment are housing 400, forward permeable membrane 408, forward intermediate permeable membrane 410, rear intermediate permeable membrane 412, and downstream permeable membrane 414, as well as secondary chamber 430 and tertiary chamber 440.

Figure 5:
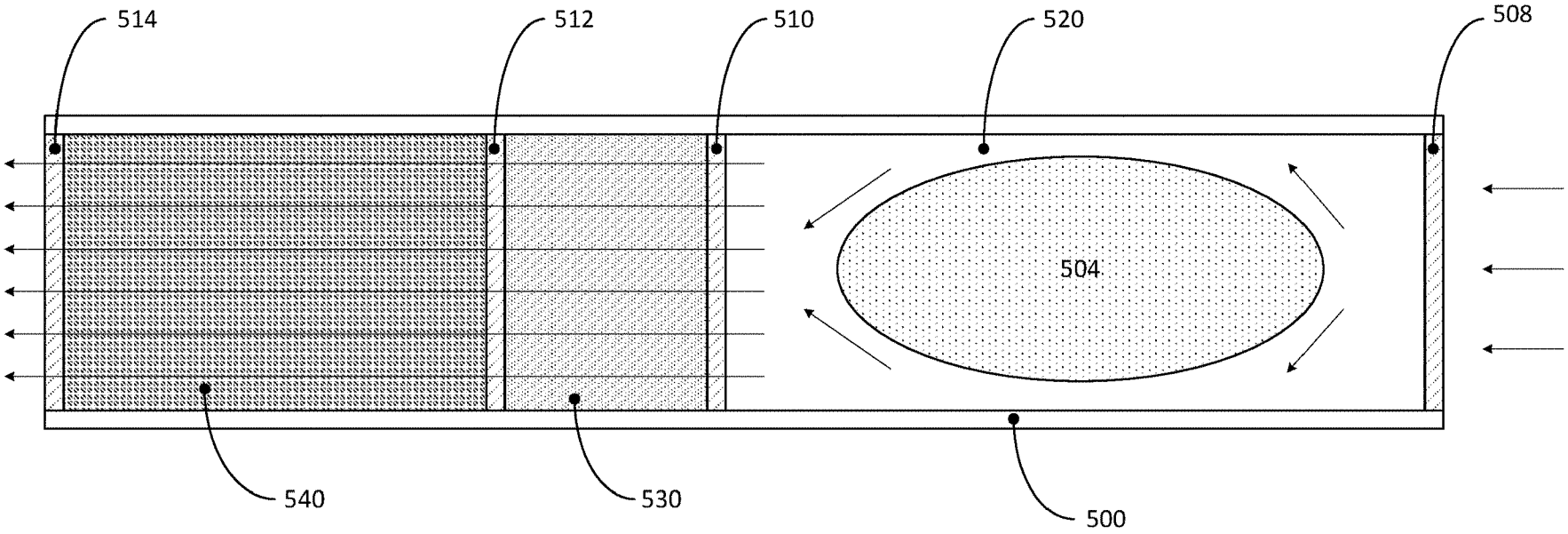
FIG. 5 is a side view of a fifth embodiment of the present design including a first oval cross section Bernoulli element.

FIG. 5 illustrates an alternate embodiment of the present design. primary chamber 120 encloses Bernoulli foil 504 within. This embodiment of Bernoulli foil 504 has a sloped angle of 40 degrees (40°) mirrored along both the longitudinal axis and the latitudinal axis. The effect of this mirroring is to create an ellipse with an equal foiling effect along each quadrant of the Bernoulli foil 504. The sloped angles of the Bernoulli foil 504 in this embodiment generally fall between the ranges of 39 and 41 degrees (39°-41°). Also shown in this embodiment are housing 500, forward permeable membrane 508, forward intermediate permeable membrane 510, rear intermediate permeable membrane 512, and downstream permeable membrane 514, as well as secondary chamber 530 and tertiary chamber 540.

Figure 6:
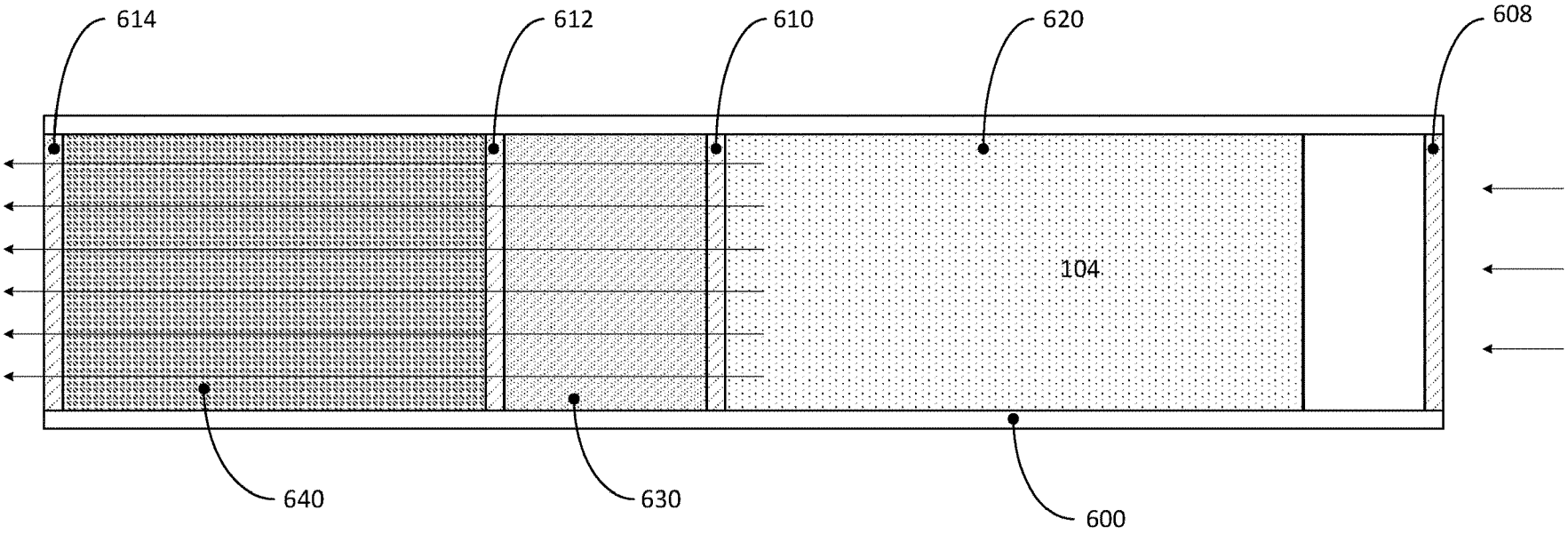
FIG. 6 is a rotated view of the embodiment of FIG. 1.

FIG. 6 illustrates the cross section of a filter device as rotated 90 degrees around the lateral axis relative to the view provided in FIG. 1. As may be appreciated, the Bernoulli foil 104 of FIG. 1 is a conically shaped element having depth into and out of the paper in FIG. 1, and this in FIG. 6 the content of the Bernoulli foil 104 covers the majority of primary chamber 120. FIG. 6 indicates an attachment location 600 of Bernoulli foil 104 at lateral edges of housing 100.

The same is true of all profiles provided in this disclosure. For example, the oval shape of FIG. 5 and Bernoulli foil 504 extends into and out of the paper in this cross-sectional view, bonding to the inside of housing 500 and primary chamber 520. Bonding may be accomplished by any way reasonable in the art that does not result in dislodging of the Bernoulli foil and does not pass harmful materials to the user. Alternate construction methods may be provided, such as a Bernoulli foil not touching the interior walls of the primary chamber as shown but instead supported by a netting or webbing within the primary chamber. Such a netting or webbing would allow airflow around the entirety of the Bernoulli foil without inhibiting air flow. Alternately, a Bernoulli foil may be provided that is supported by post-like elements, again with the Bernoulli foil not touching or contacting the interior of the housing. Again, such post-like elements may be formed of a material, such as a stiff plastic or fiber, that does not dislodge readily or cause issues with the user inhaling smoke but nevertheless permits relatively free fluid passage about the Bernoulli element. Thus as shown in various embodiments of the present design, including FIGS. 2-5 and 7, there is provided a Bernoulli element centrally fixedly mounted within one chamber where the Bernoulli element has an upper edge separated from an upper internal chamber wall by a nonzero distance and a lower edge separated from a lower internal chamber wall by a further nonzero distance and forward and rear edges separated from permeable membranes by a still further nonzero distance.

Figure 7:
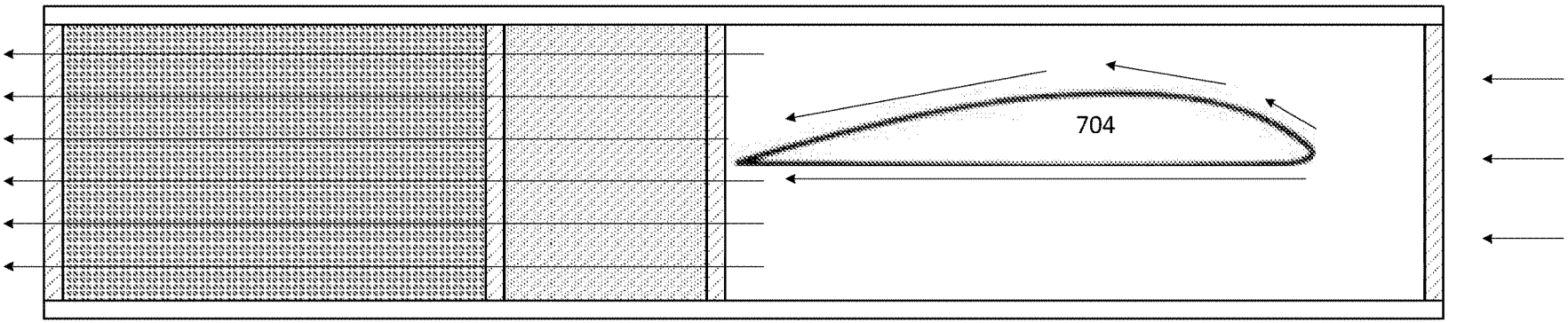
FIG. 7 is a sixth embodiment of the present design including an irregular cross section Bernoulli element shaped similar to an aircraft wing.

FIG. 7 illustrates a further embodiment of the present design. FIG. 7 includes a Bernoulli element 701 having irregular shape, here a cross sectional shape having similarities to an aircraft wing. Such a shape can cause enhanced filtering of particulate matter when a user draws fluid, such as air comprising smoke, through the filter.

Thus according to one aspect of the present design, there is provided a filter device including a Bernoulli element. The filter device includes a housing, a plurality of permeable membranes positioned in association with the housing to create a plurality of chambers in the housing, and a Bernoulli element positioned within one chamber, wherein the Bernoulli element causes airflow and pressure to vary within the one chamber when fluid comprising smoke is drawn into the filter device.

According to a second aspect of the present design, there is provided a filter device usable to filter a fluid comprising smoke drawn toward a user, comprising a forward chamber formed within a housing and positioned away from the user and formed by a first plurality of permeable membranes, the forward chamber comprising a Bernoulli element and a rearward chamber formed within the housing and positioned toward the user and formed by at least one further permeable membrane. The Bernoulli element causes airflow and pressure to vary within the forward chamber when the fluid comprising smoke is drawn into the filter device.

According to a further aspect of the present design, there is provided a method for filtering impurities from a fluid comprising smoke, comprising initially drawing fluid comprising smoke into a forward end of a multichamber housing, the multichamber housing comprising a forward chamber and a rearward chamber separated by a permeable membrane, the forward chamber comprising a Bernoulli element, and subsequently drawing the fluid comprising smoke over the Bernoulli element in the forward chamber such that fluid flow and pressure vary in the forward chamber, thereby filtering out particles from the fluid comprising smoke.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

The invention claimed is:

1. A filter device, comprising:

a housing;

a plurality of permeable membranes positioned in association with the housing to create a plurality of chambers in the housing; and a Bernoulli element fixedly mounted within one chamber, the Bernoulli element being of unitary construction employing a single material, having a noncircular cross section, and having a curved surface facing one permeable membrane of the one chamber, wherein the Bernoulli element causes airflow and pressure to vary within the one chamber by flowing around an exterior of the Bernoulli element when fluid comprising smoke is drawn into the filter device;

wherein the Bernoulli element is centrally fixedly mounted within the one chamber and has an upper edge separated from an upper internal chamber wall by a nonzero distance and a lower edge separated from a lower internal chamber wall by a further nonzero distance and forward and rear edges separated from permeable membranes by still further nonzero distances.

2. The filter device of claim 1, wherein the plurality of chambers comprises:

a forward chamber positioned way from a user when smoking through the filter device; and a rear chamber positioned toward a user when smoking through the filtering device;

wherein the Bernoulli element is positioned in the forward chamber.

3. The filter device of claim 2, further comprising an intermediate chamber.

4. The filter device of claim 1, wherein the plurality of permeable membranes comprises at least three permeable membranes.

5. The filter device of claim 1, wherein a second chamber comprises a fibrous smoke filter material.

6. The filter device of claim 1, wherein a second chamber comprises an absorptive material.

7. The filter device of claim 1, wherein the Bernoulli element is fixedly mounted to the housing such that fluid drawn toward the Bernoulli element flows freely around the Bernoulli element.

8. The filter device of claim 7, wherein the Bernoulli element comprises a rounded forward end and a tapered rear end.

9. The filter device of claim 7, wherein the Bernoulli element has an oval cross section.

10. The filter device of claim 7, wherein the Bernoulli element has an irregular shaped cross section.

11. A filter device usable to filter a fluid comprising smoke drawn toward a user, comprising:

a forward chamber formed within a housing and positioned away from the user and formed by a first plurality of permeable membranes, the forward chamber comprising a Bernoulli element centrally fixedly mounted within the forward chamber, the Bernoulli element being of unitary construction, having a noncircular cross section, employing a single material and having a curved surface facing one permeable membrane of the forward chamber, the Bernoulli element having an upper edge separated from an upper forward chamber wall by a nonzero distance and a lower edge separated from a lower forward chamber wall by a further nonzero distance and forward and rear edges separated from the first plurality of permeable membranes by still further nonzero distances; and a rearward chamber formed within the housing and positioned toward the user and formed by at least one further permeable membrane;

wherein the Bernoulli element causes airflow and pressure to vary within the forward chamber by flowing around an exterior of the Bernoulli element when the fluid comprising smoke is drawn into the filter device.

12. The filter device of claim 11, further comprising an intermediate chamber formed within the housing.

13. The filter device of claim 11, wherein the rearward chamber comprises a fibrous smoke filter material.

14. The filter device of claim 11, wherein the rearward chamber comprises an absorptive material.

15. The filter device of claim 11, wherein the Bernoulli element is fixedly mounted to the housing such that fluid drawn toward the Bernoulli element flows freely around the Bernoulli element.

16. The filter device of claim 15, wherein the Bernoulli element comprises a rounded forward end and a tapered rear end.

17. The filter device of claim 15, wherein the Bernoulli element has an oval cross section.

18. A method for filtering impurities from a fluid comprising smoke, comprising:

initially drawing fluid comprising smoke into a forward end of a multichamber housing, the multichamber housing comprising a forward chamber and a rearward chamber separated by a permeable membrane, the forward chamber comprising a Bernoulli element centrally fixedly mounted within the forward chamber, the Bernoulli element being of unitary construction, having a noncircular cross section, employing a single material, and having a curved surface facing one permeable membrane of the forward chamber and having an upper edge separated from an upper forward chamber wall by a nonzero distance, a lower edge separated from a lower forward chamber wall by a further nonzero distance, and a forward edge separated from the permeable membrane by a still further nonzero distance; and subsequently drawing the fluid comprising smoke over an exterior of the Bernoulli element in the forward chamber such that fluid flow and pressure vary in the forward chamber, thereby filtering out particles from the fluid comprising smoke.

19. The method of claim 18, further comprising drawing the fluid comprising smoke through a fibrous smoke filter material.

20. The method of claim 18, further comprising drawing the fluid comprising smoke through an absorptive material.

* * * * *